US005146880A

United States Patent [19]

Mayne

[11] Patent Number: 5,146,880

[45] Date of Patent: Sep. 15, 1992

[54] RADIAL CYLINDER MACHINE

[75] Inventor: Alfred R. Mayne, Surfers Paradise, Australia

[73] Assignee: Split-Cycle Technology Limited, Newcastle, Australia

[21] Appl. No.: 654,631

[22] PCT Filed: Jun. 27, 1989

[86] PCT No.: PCT/AU89/00275

§ 371 Date: Feb. 20, 1991

§ 102(e) Date: Feb. 20, 1991

[87] PCT Pub. No.: WO90/00218

PCT Pub. Date: Jan. 11, 1990

[30] Foreign Application Priority Data

Jun. 26, 1988 [AU] Australia ..... PI9023

Dec. 16, 1988 [AU] Australia ..... PJ2001

[51] Int. Cl.[5] ..... F02B 75/22

[52] U.S. Cl. ..... 123/55 A; 123/197.1

[58] Field of Search ..... 123/55 R, 55 A, 197 R, 123/56 C

[56] References Cited

U.S. PATENT DOCUMENTS 3,482,554 12/1969 Marthins ..... 123/55 AA 3,572,209 3/1971 Aldridge et al. ..... 123/55 AA 3,948,230 4/1976 Burns ..... 123/55 R 4,331,108 5/1982 Collins ..... 123/55 AA

FOREIGN PATENT DOCUMENTS

64760/74 5/1974 Australia .

WO86/06134 10/1986 PCT Int'l Appl. .

*Primary Examiner*—David A. Okonsky

[57] ABSTRACT

A radial cylinder machine comprises a number of equispaced lobed shafts (7) which orbit about the central machine axis inwardly of the pistons (13). The lobed shafts (70) also rotate about their individual axes by virtue of planetary pinions on each shaft (7) meshing with a fixed ring gear. The orbiting and rotating lobes (9) act as cams on the inward faces of the pistons (13) whereby there is inter-conversion of reciprocatory motion of the pistons (13) and rotary motion of the lobed shafts (7). The lobed shafts (7) are mounted on a carrier fixed to a central axis input/output shaft whereby torque may be transferred permitting the machine to act as an engine or pump. There is also disclosed a means of maintaining contact between the pistons (13) and the lobes (9).

22 Claims, 7 Drawing Sheets

RADIAL CYLINDER MACHINE

FIELD OF INVENTION

This invention relates to linear to rotary motion conversion in machines such as reciprocating piston internal combustion engines and fluid pumps.

Commonly linear to rotary motion conversion in machines is carried out by a crank and connecting rod. Notwithstanding the many disadvantages of this mechanism, well known in the art, no better solution has yet been found for many applications.

BRIEF DESCRIPTION OF THE PRIOR ART

Examples of machines which offer an alternative to the crank and connecting rod arrangement are shown in Australian Patents 473864 and 466936, U.S. Pat. Nos. 2,032,495 and 3,572,209, European Patent Application 64726, United Kingdom Application 476247 and PCT published Specifications WO86/06134 and WO86/06787.

It is an object of the present invention to provide a practical alternative reciprocating/rotary motion conversion mechanism in a machine.

SUMMARY OF THE INVENTION

One broad form of the invention can be described as a machine having a primary axis and comprising:

- a plurality of radially reciprocable pistons disposed radially of said primary axis; and
- a circular array of lobed shafts constrained for orbital motion about said primary axis, each shaft being rotatable about a respective secondary axis parallel to the primary axis at a rate being a predetermined proportion of their orbital rate, and the planes of the lobes lying approximately in the radial plane of the pistons, and wherein during the rotation and orbit of the shafts and reciprocation of the pistons each piston maintains substantially continuous contact with at least one lobe throughout each cycle of reciprocation of that piston, and further wherein there is a transition without substantial time delay, between each successive cycle of reciprocation of each piston defined by the period between contact and separation of respective successive lobes and said piston.

Preferably the pistons are arranged in pairs, the pistons of each pair pumping fluid from one to the other in response to piston reciprocation so as to maintain substantially asynchronous reciprocation of the pistons of each pair.

Preferably the machine additionally comprises a main shaft rotatable about the primary axis and in torque transmitting connection with the array of lobed shafts. The main shaft may include a rigidly connected radial web supporting each lobed shaft in a position fixed relative to the web and being equally spaced about a pitch circle of the web. It is an advantage to have two such webs spaced along the main shaft and rotatably supporting the lobed shafts in the annular space therebetween.

Preferably the predetermined proportion of rotational to orbital rates of the lobed shafts is effected by intermeshed planet and ring gears, the plane gears being rigidly concentrically connected one to each shaft and the ring ear being fixed concentrically of the primary axis. The ring gear may be fixed to a casing which rotatably supports the main shaft via suitable bearings.

Conveniently each piston resides in a cylinder cooperatively defining a lower variable volume chamber being a fluid pumping chamber radially intermediate of the piston and filled with a fluid to be pumped between the respective pumping chambers of the pair of pistons in response to piston reciprocation. Each piston and respective cylinder may also define an upper variable volume chamber radially outwardly of the piston between a top of the piston and a radially outer closed end of the cylinders and which may be utilized as a conventional internal combustion chamber.

In a preferred arrangement of the invention each piston includes top and bottom separated piston halves rigidly interconnected by at least one radially aligned rod passing sealingly through an intermediate transverse cylinder wall so as to define the fluid pumping chamber between the bottom piston half and the intermediate cylinder wall, the upper variable volume chamber between the top piston half and the closed end of the cylinder and an intermediate variable volume chamber between the top piston half and the intermediate cylinder wall. The intermediate variable volume chamber may be an induction chamber for effecting and/or controlling air or air/fuel mixture pumping into the combustion chamber as part of an internal combustion process.

The induction chamber may include inlet and transfer ports entering through its cylinder wall and being opened and closed in timed relation to piston movement by the top piston half, in the manner of conventional two-stroke piston controlled port timing.

In one embodiment the lobes of the lobed shafts lie in a common plane and during rotation overlap at their tips with the tips of the lobes of each adjacent lobed shaft. The lobes of each shaft having a transverse indent symetrically opposed to the transverse indent of lobes of both adjacent lobed shafts.

In an alternative embodiment the lobes of the lobed shafts lie in two adjacent parallel planes, the lobes of adjacent shafts being in alternatives ones of said two planes. During rotation the lobes of adjacent shafts closely overlap.

As another preferred feature, each lobe may include a leading edge with a raised portion which is located so as to provide a point, line, or area of initial contact between the lobe and the pistons. Where the lobes include transverse indents each raised portion is radially within the inner most extent of the respective indent.

A further preferred feature provides a resilient initial contact point in each piston so as to cushion initial contact between the piston and the lobes at the commencement of each cycle of reciprocation. Alternatively or in combination with the resilient initial contact point the pistons and/or surrounding cylinders include resilient contact lines or points to cushion each piston at its inner most turning point of its reciprocating travel. Preferably the resilient contact lines and/or points are provided by resilient silicon material.

BRIEF DESCRIPTION OF THE DRAWINGS

By way of example only a preferred embodiment of the invention will now be described with reference to the accompanying drawings, in which.

DESCRIPTION OF PREFERRED EMBODIMENTS

Figure 1:
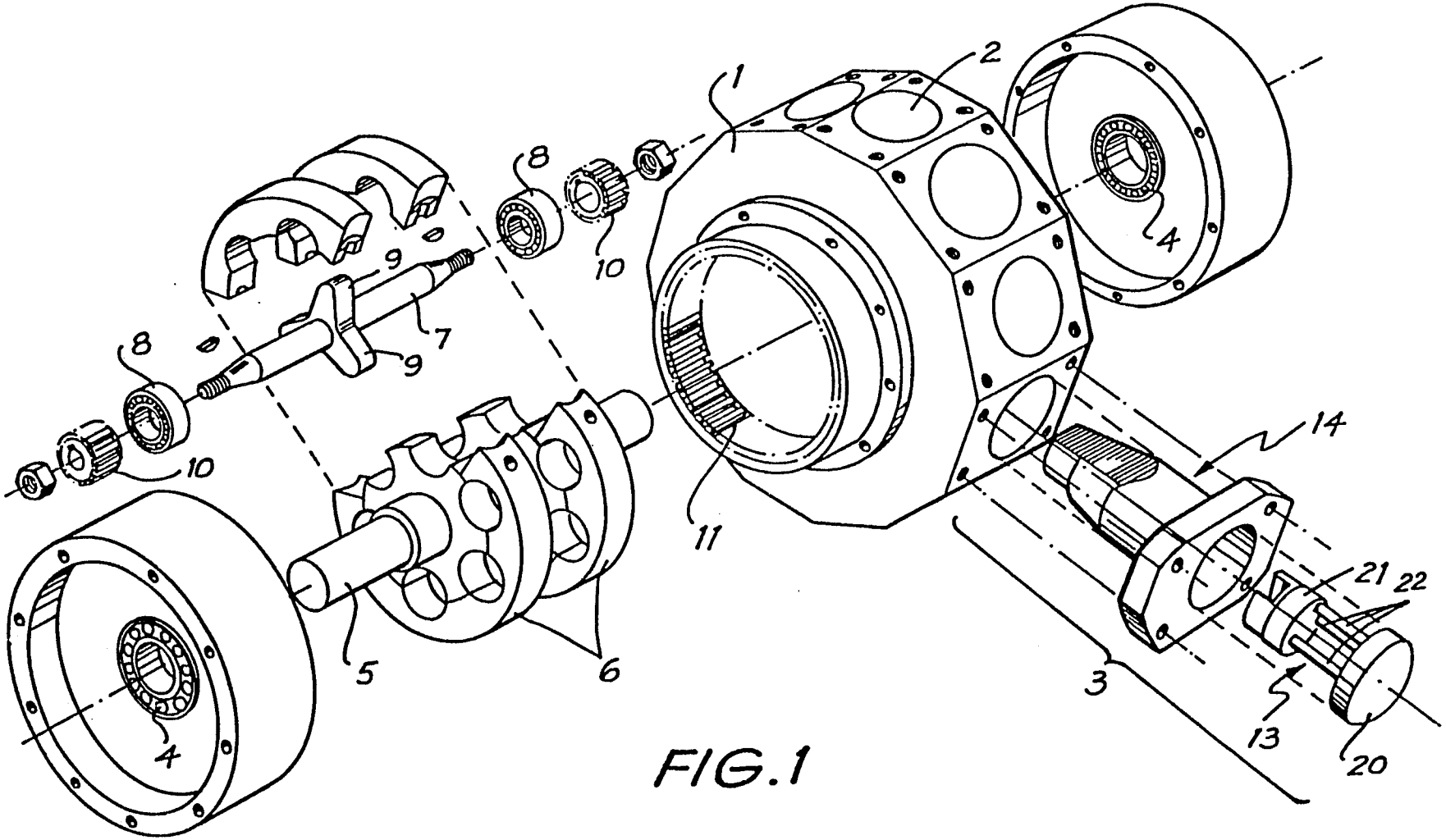
FIG. 1 is an exploded, partially fragmented, perspective view of the major operating components of an internal combustion engine embodying the invention.

The engine of the drawings is of a generally radial configuration having twelve pistons undergoing a substantially conventional two stroke combustion cycle. The bulk of the engine is housed within a casing or block 1 which need only withstand generally radial forces of not substantial magnitude and can therefore be lightweight and of simple design.

The casing 1 includes twelve equally radially spaced and radially aligned cylindrical cavities 2 adapted to receive piston/cylinder assemblies 3 in a close sliding fit. The piston/cylinder assemblies 3 are bolted into position and will be discussed later in detail.

Main bearings 4 are supported at respective axial ends of the casing 1 and rotatably secure the mainshaft 5 with its rigidly attached rotors 6 between the two main bearings 4. The rotors 6 carry a number of lobed shafts 7 parallel to the main shaft 5 and rotating in secondary bearings 8. There are six lobed shafts 7, and, as seen in FIGS. 2 and 3, each shaft 7 includes three lobes 9, the lobes 9 of adjacent shafts 7 somewhat overlap so that in operation of the device each piston is engaged with a lobe of a shaft 7 at all times during its reciprocation.

The lobed shafts 7 carry planet gears 10 externally of the secondary bearings 8 and attached to the shafts 7 so as to turn as an integral component. Each of the planet gears 10 engages one of two ring gears 11 attached in the radial planes at each axial end of the casing 1. Thus rotation of the main shaft 5 results in the shafts 7 orbiting about the main shaft 5 and proportionately revolving about their own respective axes. The shafts 7 all revolve at the same rotational speed proportional to the speed of rotation of the main shaft 5 as determined by the gearing ratio between the planet gears 10 and the ring gear 11.

End covers 12 sealingly enclose the gear trains consisting in the ring gear 11 and planet gears 10, conveniently support the main bearings 4, and allow the sealed protrusion of one end of the main shaft 5 to provide a power take-off.

Figure 2:
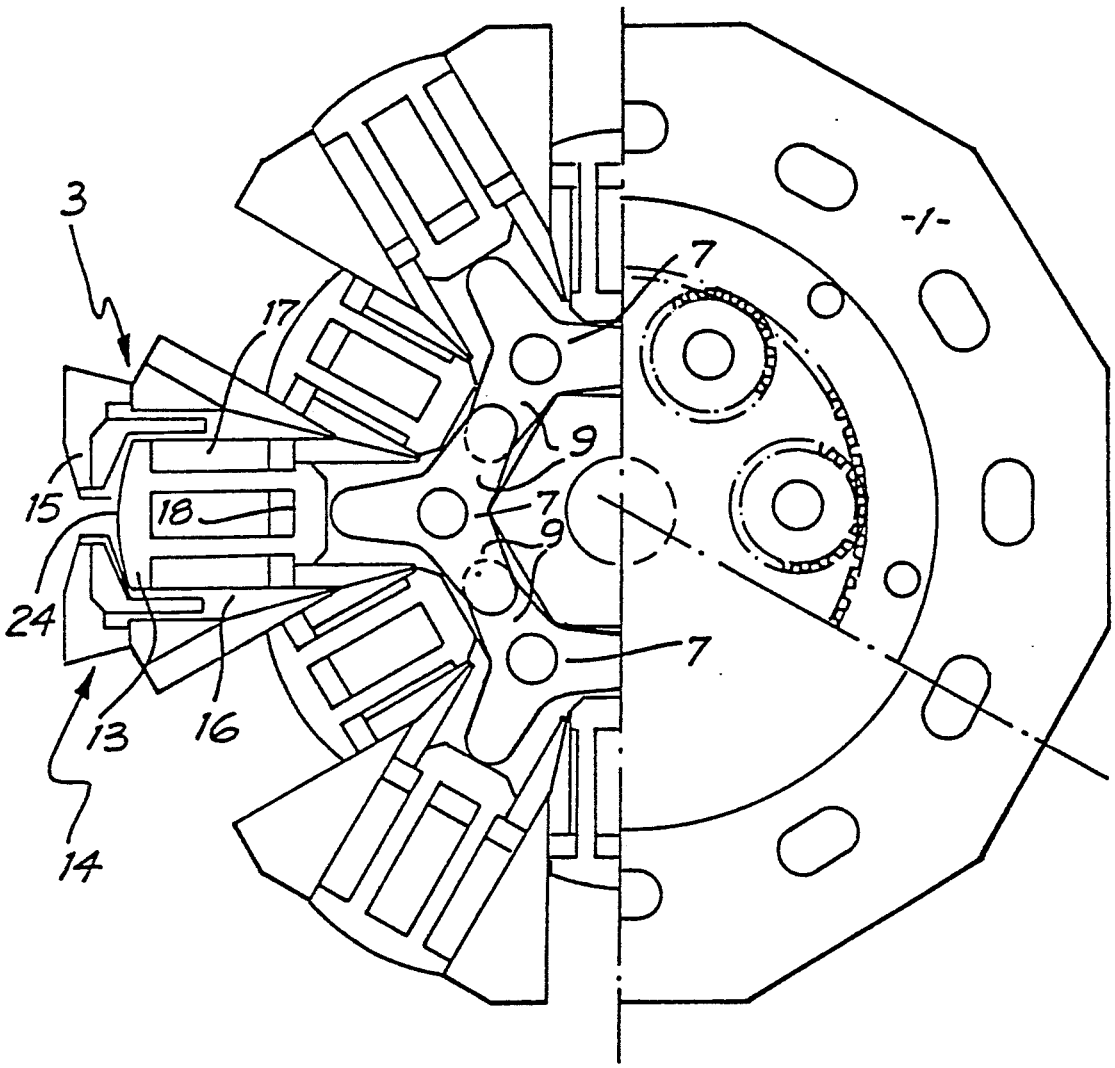
FIG. 2 is a multiple sectioned axial elevation of the engine shown in FIG. 1.

Shown in FIG. 2 is a piston/cylinder assembly 3 in place in the casing 1. The piston 13 can reciprocate in the radial direction within the cylinder 14 which includes in unit construction a head portion 15 and cylinder bore portion 16. Seen most clearly perhaps in FIG. 3 the bore portion 16 can be divided into two sections, a radially outer section 17 and a radially inner section 18 divided by a transverse intermediate cylinder wall 19. The piston 13 comprises a top piston half 20 and a bottom piston half 21 rigidly interconnected by three round sectioned rods 22 arranged equally radially spaced about the centre line of the piston 13. The rods 22 pass through sealed apertures within the intermediate cylinder wall 19. Such construction provides three variable volume chambers 17, 18 and 24, chamber 24 being the combustion chamber between the top piston half 20 and the cylinder head 15.

Shown in the drawings of FIG. 3 is the fluid pumping action which maintains the two pistons 13a, 13 b of a cooperative pair in asynchronous reciprocatory motion. The variable volume chambers 18a, 18 b defined between the botfom piston half 21 and the intermediate cylinder wall 19 of each pair of piston/cylinder assemblies 3 (FIG. 1) are filled with a fluid and linked by a fluid interconnection 23. The total volume of the fluid remains constant for incompressible liquids and substantially constant for compressible gases, the volume of one chamber 18b of the piston 13b advancing outwardly is reduced thus pumping the fluid out into the corresponding chamber 18a of the other piston 13a thus forcing an increase in the pressure in chamber 18a causing retraction of its piston 13a. During normal operation of the internal combustion engine this mechanism is not relied upon other than as a safety factor. Normally combustion pressures will force the retracting piston 13a inwardly, causing the connected shaft 7a to revolve and thereby orbit, in turn advancing the other piston 13b of the pair. However during starting and stopping procedures or in the event of certain failures, the pumping action of the first fluid between the two chambers 18a, 18b retains the piston 13 of each pair in their correct 180° out of phase reciprocatory action.

The planetary gear 10 to ring gear 11 ratio is selected in consideration of the number of shafts 7, the number of lobes 9 per shaft 7 and the number of pistons 13 to ensure that during engine rotation as each shaft 7 is in turn orbitally positioned directly radially below each piston 13a, 13b its lobes 9 in turn axially align radially with each piston 13. Thus the shaft 7a shown in FIG. 3(a) is positioned radially directly below the piston 13a while in FIG. 3(c) shaft 7a is positioned radially beneath the piston 13b and has revolved anticlockwise through one third of a revolution (there are three lobes 9 for each shaft 7 in this embodiment). Also as seen in FIG. 3(a), as lobe 9c of the shaft 7b leaves contact with the bottom piston half 21b a lobe 9b of the next proceeding shaft 7a comes into contact, overlapping the departing lobe 9c, with the bottom piston half 21b. Similarly in FIG. 3(c), lobe 9d replaces the lobe 9a in contact with the bottom half 21a of piston 13a. This point of simultaneous contact of lobes 9 of adjacent shafts 7 occurs at the bottom travel position of the respective piston 13 (equivalent to bottom dead centre in a crank/connecting rod prior art mechanism).

By this mechanism, the pistons 13 are each continuously in contact with lobes 9 of consecutive shafts 7. Also, for each complete revolution of the main shaft 5 each cylinder fires six times (i.e. one for each shaft 7).

The variable volume chambers 17a, 17b enclosed between the intermediate cylinder wall 19 and the top piston halves 20a, 20b is used to pump fuel air mixture into the combustion chamber 24 in a manner similar to the crank case of a conventional two stroke internal combustion engine. The cylinder bore portion 16 includes inlet, transfer and exhaust ports, the opening and closing of the ports being controlled and timed relative to movement of the piston 13 by the sliding surface of the top piston half 20. As with conventional two stroke combustion cycle engines reed valves, multiple porting, acoustical exhaust timing and supercharging amongst others may be incorporated to improve the performance of the engine.

Figure 5:
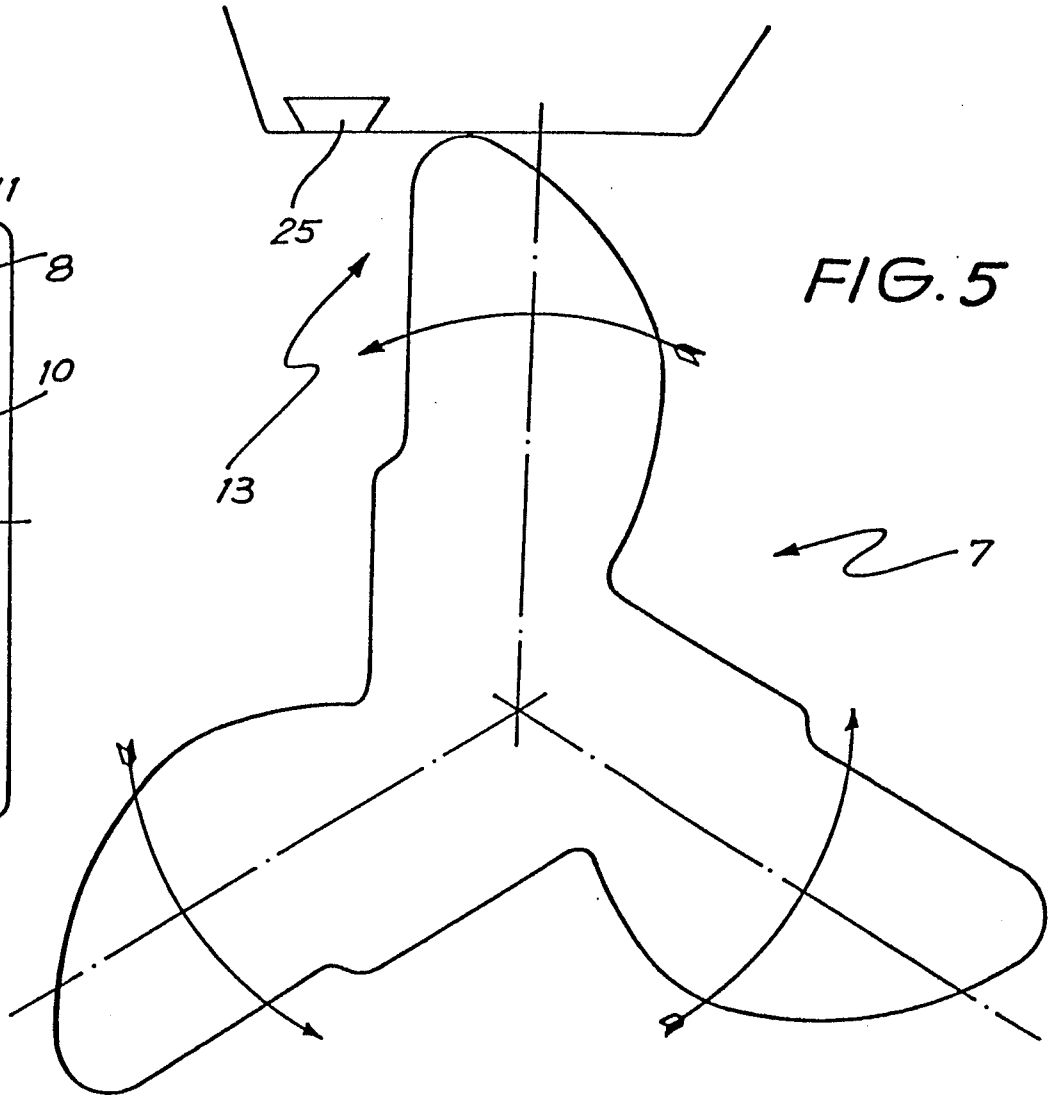
FIG. 5 is a detailed view of a single component of the engine having a preferred profile.

The lobes 9 of the shafts 7 can be profiled to provide an asymetric reciprocation. FIG. 5 illustrates one profile designed to give a slower piston speed on the downward power stroke than on the upward compression stroke. This allows, amongst other things, for better scavenging.

Also shown in FIG. 5 is a resilient insert 25 located in a bottom face at the bottom piston half 21 and positioned to be at the point of first contact with a lobe 9 in order to provide some cushioning if necessary.

The combustion cycle of the engine is seen in FIG. 3*a* with piston 13*b* commencing its compression stroke. The combustion chamber 24*b* has already been at least partially filled with an air fuel mixture which is gradually compressed as the combustion chamber 24*b* decreases in size, FIG. 3*b*, as the shaft 7*a* is rotated anticlockwise by action of the piston 13*a* in its power stroke. As well as the shaft 7*a* advancing the piston 13*b* during its anticlockwise rotation it also causes the rotors 6 to rotate clockwise by the action of its planet gear 10 against the ring gear 11.

During the upward compression stroke of piston 13*b* the fluid chamber 18*b* decreases in volume thus pumping its fluid through passage 23 into the corresponding chamber 21*a* of piston 13*a*.

Furthermore, the induction chamber 17*b* increases in volume during the compression stroke of piston 13*b*. The chamber 17*b* is connected to a metered air/fuel supply such as a carburettor, via an inlet port (not shown). The pressure drop within the increasing volume 17*b* causes induction of the air fuel mixture in the manner of a conventional two stroke cycle engine crank case.

The shaft 7*a* continues to rotate anticlockwise and orbit clockwise under the action of the power stroke piston 13*a* driving the compression piston 13*b* to its topmost position at which point the combustible air/fuel mixture has already been ignited and, as with conventional reciprocating piston internal combustion engines, it commences its power stroke.

Figure 3C:
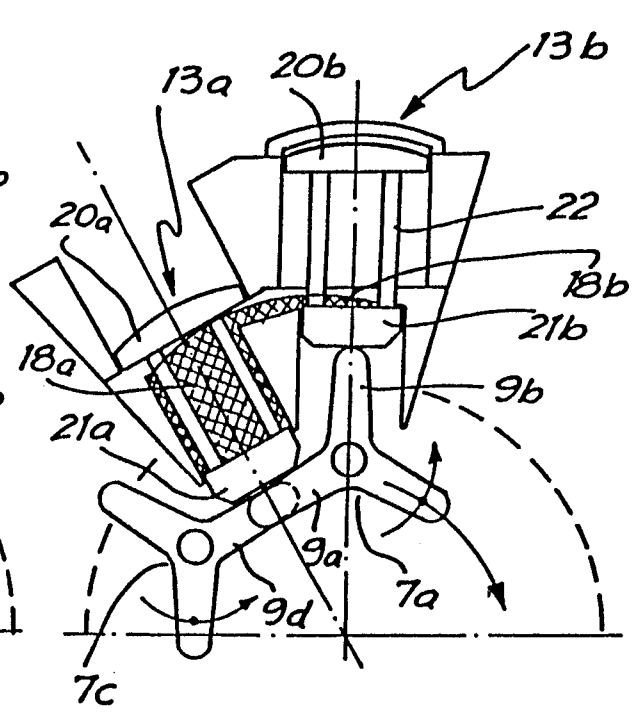
FIG. 3 is a three part (3a, 3b, 3c) schematic representation in axial elevation of an operational feature of the engine of FIGS. 1 and 2.
Figure 3B:
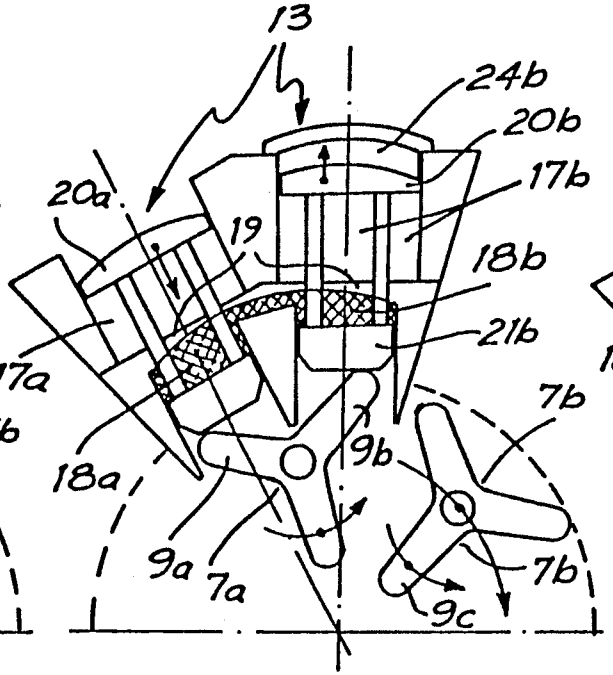
Figure 3A:
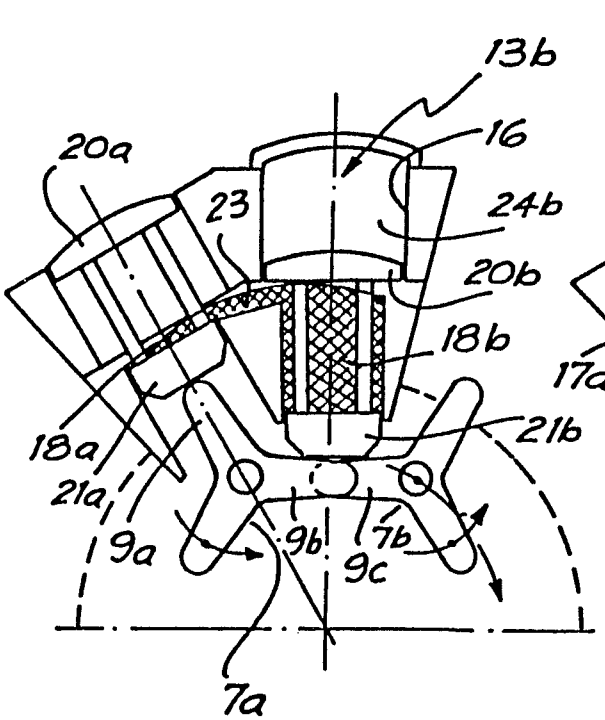

In the position shown in FIG. 3*c* the fluid chamber 18*b* has also reached its minimum volume while the induction chamber 17*b* has reached its maximum volume. Neglecting fluid momentum the flow of fluid out of chamber 18*b* and the induction of fuel/air into chamber 17*b* has now ceased.

The power stroke can be seen in piston 13*a*, commencing in FIG. 3*a*. The freshly ignited air fuel mixture causes a sharply rising combustion pressure within the combustion chamber 24*a* forcing the piston 13*a* to retract inwardly as in FIG. 3*b*. The combustion pressure upon the top piston half 20*a* is transmitted through the piston rods 22*a* and piston bottom half 21*a* to the lobe 9*a* of the shaft 7*a*. This force produces the torque turning shaft 7*a* as discussed previously with reference to the compression stroke.

Also during the power stroke the induction chamber 17*a* decreases in volume and pumps its air fuel mixture out through a transfer port (not shown) leading into the combustion chamber 24*b* for replenishing the air fuel mixture. The timed control of the air fuel mixture flow into and out of the induction chamber 17*a* and into the combustion chamber 24*a* can be controlled by any one of a number of conventional methods including reed valves, piston interaction with port openings, disc valves and supercharging.

The increasing volume of fluid chamber 18*a* is filled with the fluid pumped from the decreasing volume fluid chamber 18*b*. Where, for some reason such as combustion failure, or when starting or stopping the engine, where there is not the combustion pressure to cause retraction of the piston 13*a* then the pressure of the fluid within chamber 18*a* increases under the pumping action of the reducing volume fluid chamber 18*b* thus pressuring the bottom piston half 21*a* radially inwardly and maintaining its contact with the lobe 9*a*.

Figure 6:
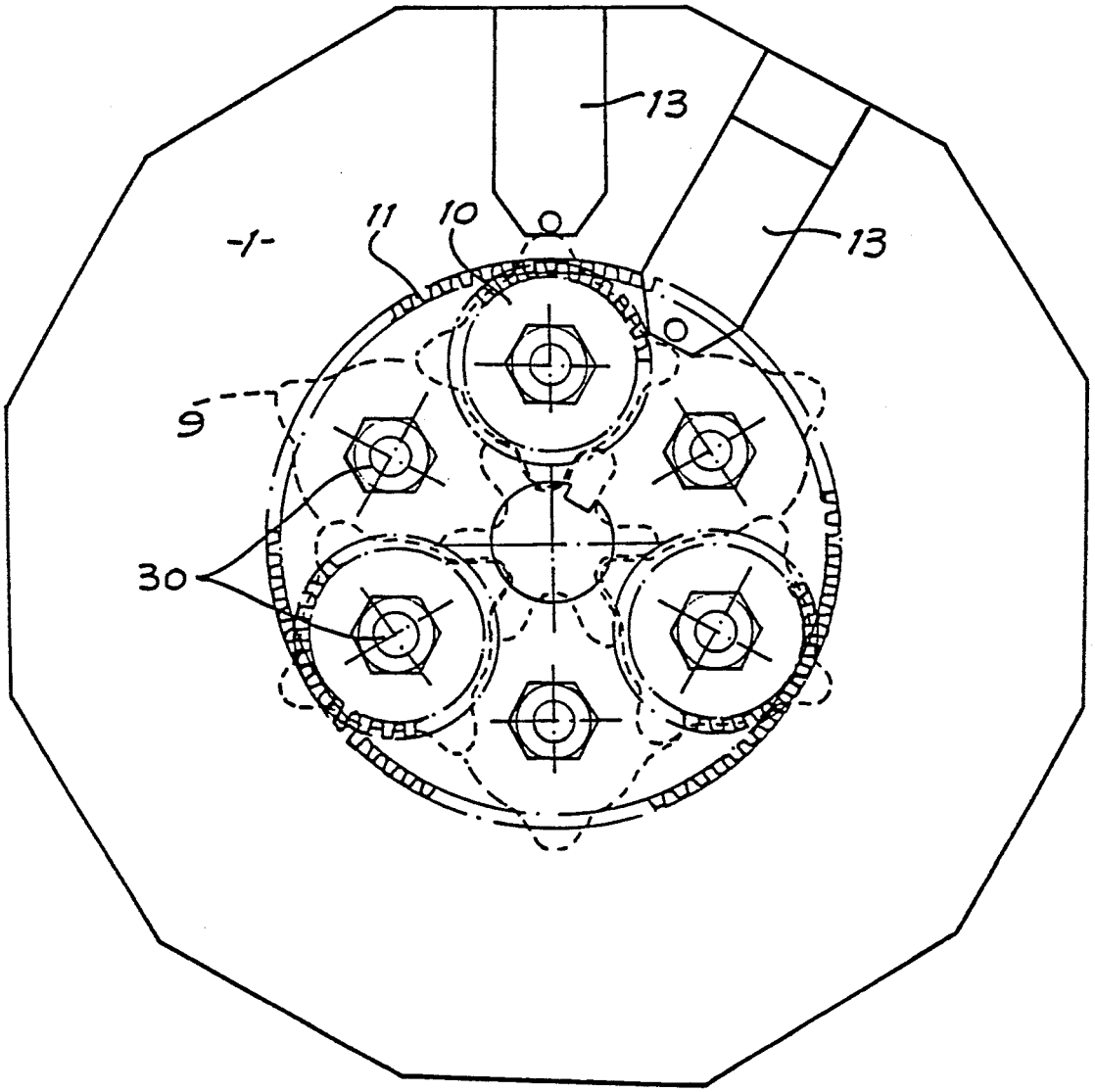
FIG. 6 is an axial view of an alternative embodiment of the invention.

FIG. 6 shows the internals of a four lobe variant of the invention. As with the motor already described there is an orbital array of lobed shafts 30 constrained for general reversed rotation relative to their orbital movements effected by planet gears 10 and ring gear 11. In this case there are also twelve pistons 13 but each of the six orbital shafts 30 carries four lobes (rather than three) and therefore rotates at $\frac{3}{4}$ the gearing ratio of the three lobal variant so as to ensure matched engagement of consecutive lobes 9 with consecutive pistons 13. The planet gears 10 are disposed at opposite axial ends of the case 1 for adjacent lobed shafts 30 as they would otherwise interfere with one another.

Thus the engine provides a compact multicylinder flat radial engine, the diameter of which is substantially less than that which would be necessarily employed in a more conventional crank and connecting rod mechanism. Because the combustion process itself and the general reciprocating piston and combustion chamber shapes are conventional, optimal combustion chamber shape and gas sealing are readily achievable.

Figure 7:
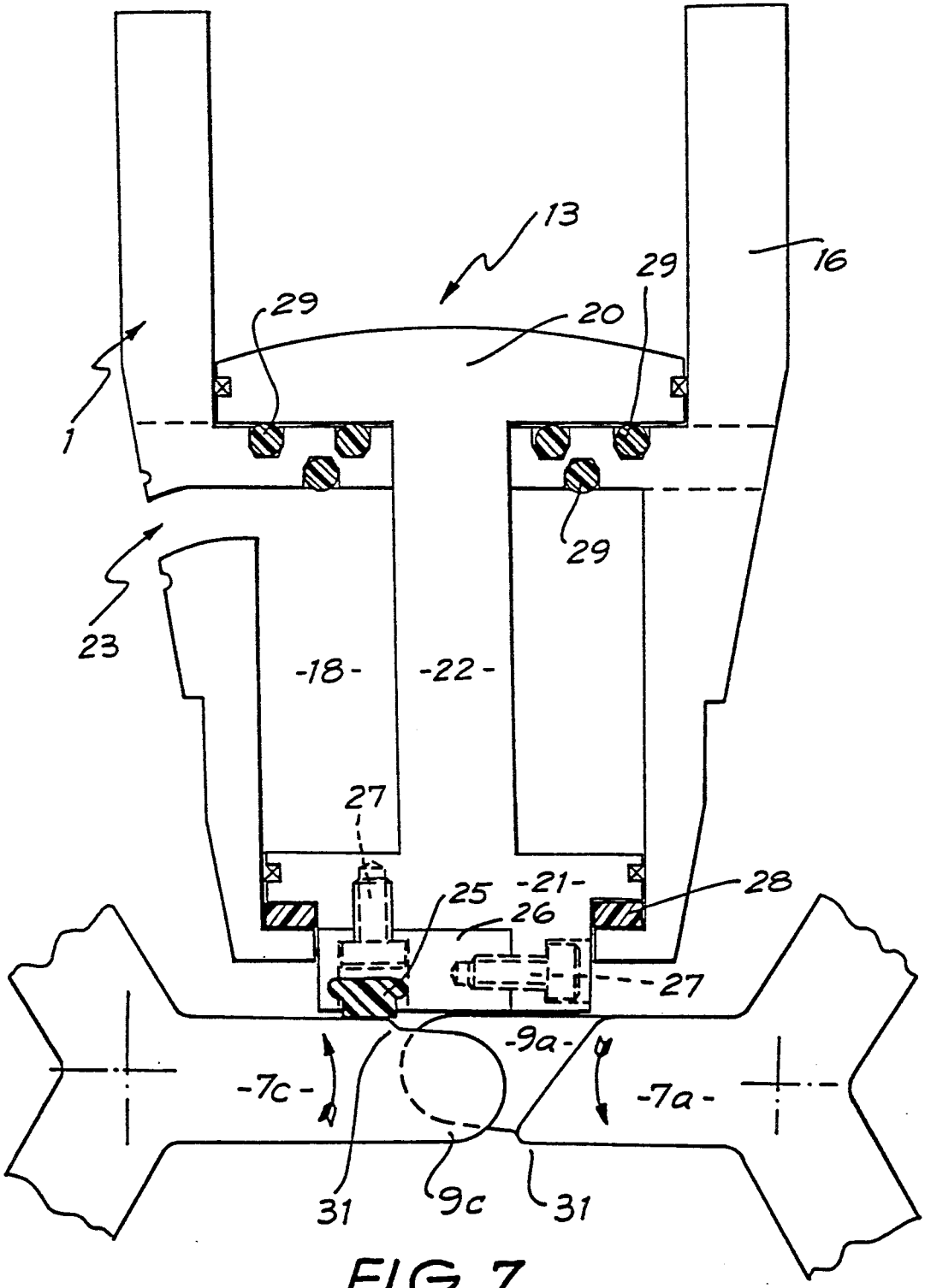
FIG. 7 is a view similar to that of FIG. 3 but showing further preferred features.

In FIG. 7 a number of alternative features are shown in an alternative embodiment of the invention. These alternatives relate particularly to the lobed shafts 7, the design of the piston 13 and the insertion of certain cushioning devices.

Figure 4:
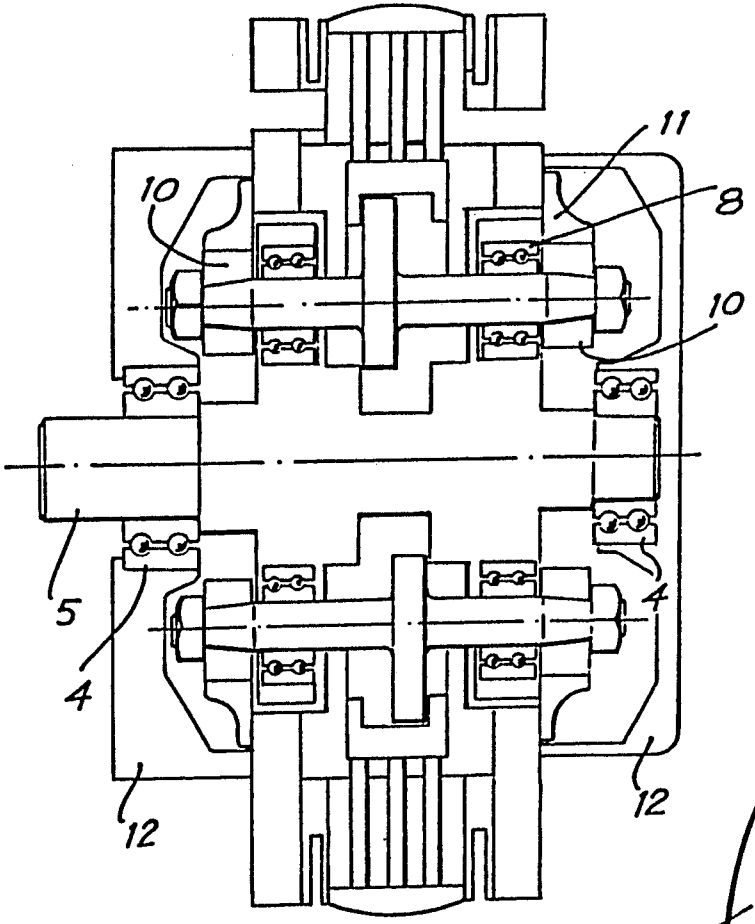
FIG. 4 is a sectioned radial elevation of the engine shown in FIGS. 1 and 2.
Figure 7A:
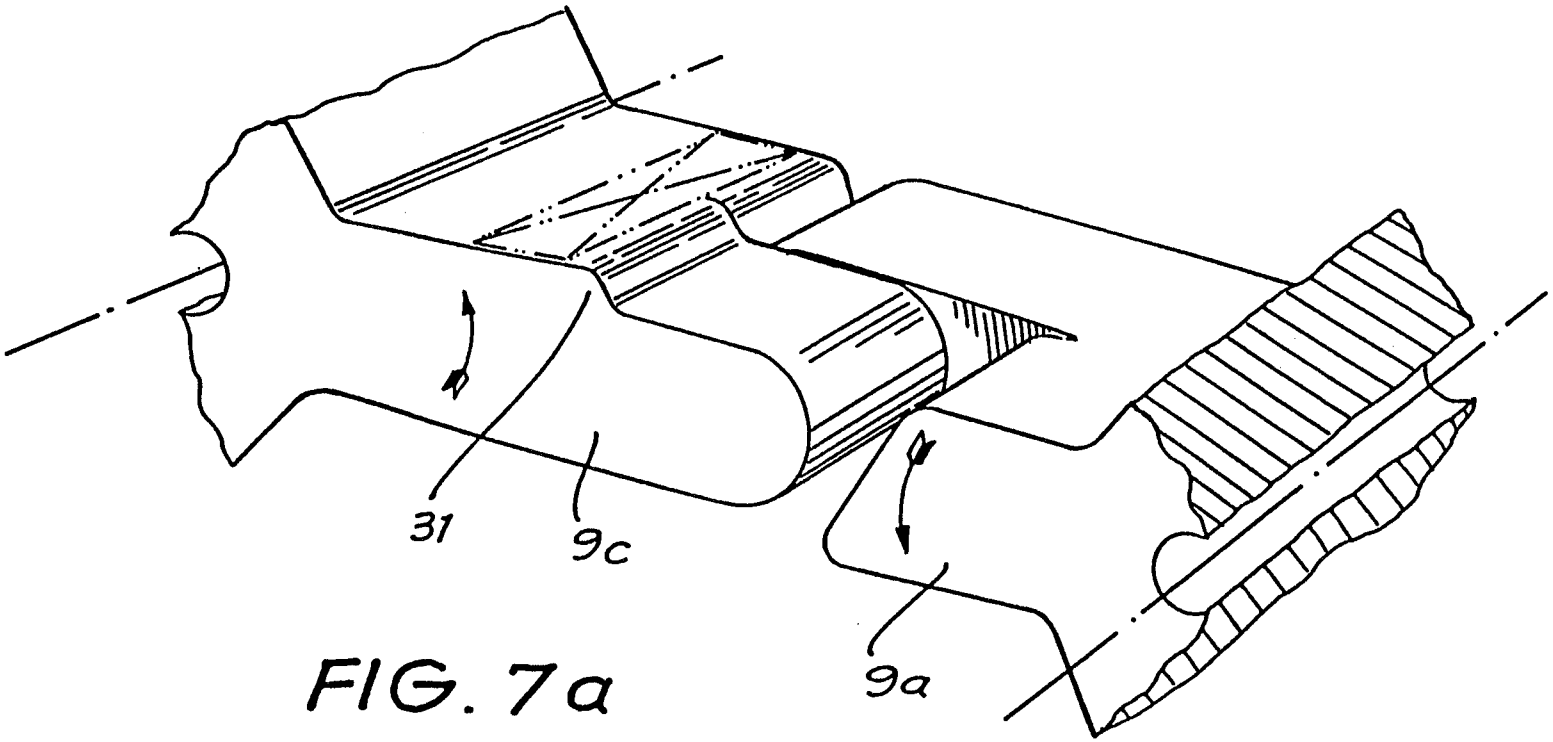

The lobed shafts 7*a* and 7*c* shown in FIG. 7 include raised portions 31 which provide initial engagement of the lobes 9 with the resilient insert 25 on the bottom face of the piston 13. The raised portions 31 are radially within the tip of the lobes 9 which overlap one another. In comparison with arrangement of FIG. 4 the lobes 9 of adjacent lobed shafts 7 are co-planar and the tips include symetrically indented portions as shown in FIG. 7*a* to allow for their overlapped movement. Thus, the raised portions 31 extend the full width of each lobe 9 and a maximum contact area with the resilient insert 25 can be obtained.

Through the majority of the cycle of reciprocation the contact between each lobe 9 and the piston 13 is a substantially rolling contact of the tip portion of the lobe 9 with the hardened steel insert 26. The insert 26 is fixed rigidly to the piston 13 by suitable screws 27 although many other feasible fixing methods are available in the art.

The intermediate cylinder wall 19 includes three annular resilient silicon rings 29. Two of these rings 29 are included in the upper surface of the intermediate wall 19 and cushion the piston 13 at its radially innermost turning point in its reciprocation cycle by virtue of the inner surface of the top piston half 20 engaging the silicon rings 29. Similarly, the third silicon ring 29 in the radially inner most face of the intermediate wall 19 will provide a cushioning at the radially outer most turning point of the piston 13 should the outer most surface of the bottom piston half 21 engage the silicon ring 29. The three silicon rings 29 are conveniently concentric.

A rectangular cross-sectioned silicon ring 28 is provided internally at the bottom of the cylinder 16 to engage with a radially inwardly facing surface portion of the bottom piston half 21. This further silicon ring 28 is sized and positioned so as to provide a final deceleration and initial acceleration of the piston 13 during its transition through the radially inner most turning point of its cycle of reciprocation. During this deceleration of the piston 13 the rubber ring 28 will store the remaining connecting energy of the piston 13 and reapply it so as to commence the radially outward acceleration of the piston 13 as, or slightly before, the raised portion 31 of the lobe 9c contacts the resilient insert 25.

Although the preferred embodiment has been described consisting of twelve cylinders, there is little restriction to the number of cylinders which may be employed, similarly the bore and stroke of the pistons can be any combination of sizes.

An important factor in the performances of an engine is internal friction. Perhaps most importantly in high performance engines is the piston/cylinder friction where lubrication is at a limiting stage. In the engine of the present invention there is substantially no transverse force applied to the piston while in a conventional connecting rod/crank mechanism considerable side force is applied to the piston by the connecting rod, especially at high engine speeds.

All of the moving components of the engine can be made relatively light and with little rotational momentum allowing the motor to rev more easily than a conventional crank/connecting rod engine. The lack of rotational momentum should not compromise its performance at very low engine speeds in view of the large number of evenly spaced firings per revolution of the output shaft.

The size of the engine capacity can be readily increased within a given range by simply removing the cylinders and replacing them with cylinders of an alternative piston bore size. Where a significant change in the engine capacity is desired then, certainly, a larger engine case is required, however the physical dimensions of the engine increase at a fraction of the rate of the engine capacity increase, and it is envisaged that for an engine of twice the width and twice the overall diameter there is available an eight fold increase in the engine capacity.

I claim:

1. A machine having a primary axis and comprising:

a plurality of radially reciprocable pistons disposed radially of said primary axis; and a circular array of lobed shafts constrained for orbital motion about said primary axis, each shaft being rotatable about a respective secondary axis parallel to the primary axis, the shafts being rotatably driven by drive means at a rate being a predetermined proportion of their orbital rate, and the planes of the lobes lying approximately in the radial plane of the pistons, and wherein during the rotation and orbit of the shafts and reciprocation of the pistons each piston is connected with at least one lobe for rotation and orbit of the shaft in unison with reciprocation of that piston.

2. A machine having a primary axis and comprising:

a plurality of radially reciprocable pistons disposed radially of said primary axis; and a circular array of lobed shafts constrained for orbital motion about said primary axis, each shaft being rotatable about a respective secondary axis parallel to the primary axis at a rate being a predetermined proportion of their orbital rate, and the planes of the lobes lying approximately in the radial plane of the pistons, and wherein during the rotation and orbit of the shafts and reciprocation of the pistons each piston maintains substantially continuous contact with at least one lobe throughout each cycle of reciprocation of that piston, and further wherein there is a transition without substantial time delay, between each successive cycle of reciprocation of each piston defined by the period between contact and separation of respective successive lobes and said piston and wherein said pistons are arranged in pairs, the pistons of each said pair pumping fluid from one to the other in response to piston reciprocation so as to maintain substantially asynchronous reciprocation of the pistons of each pair.

3. A machine as defined in claim 2 additionally comprising a main shaft rotatable about said primary axis and being in torque transmitting connection with the array of lobed shafts.

4. A machine as defined in claim 3 wherein said main shaft further includes a pair of parallel spaced apart rigid radial webs rotatably supporting said lobed shafts therebetween and equally spaced about a pitch circle of said webs.

5. A machine as defined in claim 2 wherein said predetermined proportion of rotational to orbital rates of the lobed shafts is affected by intermeshed planet and ring gears, said planet gears being rigidly concentrically connected one to each shaft and the ring gear being fixed concentrically of said primary axis.

6. A machine as defined in claim 1 wherein said drive means includes intermeshed planet and ring gears, said planet gears being rigidly concentrically connected one to each shaft and the ring gear being fixed concentrically of said primary axis.

7. A machine as defined in claim 6 wherein said ring gear is fixed to a casing which rotatably supports said main shaft in bearings.

8. A machine as defined in claim 7 wherein each piston resides in a cylinder cooperatively defining a lower variable volume chamber being a fluid pumping chamber radially inward of said piston and filled with a fluid to be pumped between the respective pumping chambers of the pair of pistons in response to piston reciprocation.

9. A machine as defined in claim 8 wherein each said piston and respective said cylinder further defines an upper variable volume chamber radially outwardly or said piston between a top of said piston and a radially outer closed end of said cylinder, said upper variable volume chamber being utilised as an internal combustion chamber.

10. A machine as defined in claim 9 wherein each said piston includes a top and a bottom separated piston half rigidly interconnected by at least one radially aligned rod passing sealingly through an intermediate transverse cylinder wall so as to define said fluid pumping chamber between said bottom piston half and said intermediate cylinder wall, said upper variable volume chamber between said top piston half and said closed end of said cylinder and an intermediate variable volume chamber between said piston top half and said intermediate cylinder wall to define an induction chamber for effecting and/or controlling air or air/fuel mixture pumping into said combustion chamber as part of said internal combustion process.

11. A machine as defined in claim 1 wherein each said piston includes a top and a bottom separated piston half rigidly interconnected by at least one radially aligned rod passing sealingly through an intermediate transverse cylinder wall so as to define a fluid pumping chamber between said bottom piston half and said intermediate cylinder wall.

12. A machine as defined in claim 11 wherein said fluid pumping chamber of each piston is fluidly connected to the respective fluid pumping chamber of one adjacent said piston, the connected said fluid pumping chambers being filled with a fluid so as to provide asynchronous reciprocation of respective pistons of each said pair of pistons.

13. A machine as defined in claim 1 wherein said lobes lie in a common plane and include indented tip portions which overlap indented tip portions of respective adjacent lobes during said orbital motion of said shafts.

14. A machine as defined in claim 1 wherein the lobes of each lobed shaft lie in one of two parallel closely spaced apart planes, the lobes of adjacent lobed shafts overlapping one another during rotation and being respectively within one and the other of said two parallel planes.

15. A machine as defined in claim 1 wherein each said lobe includes on a leading edge a raised portion located on said lobes so as to provide a point, line, or area of initial contact between said lobe and said piston.

16. A machine as defined in claim 15 wherein each piston includes a resilient insert at said point, line, or area of initial contact.

17. A machine as defined in claim 1 further comprising resilient cushions fixed to the pistons and surrounding piston cylinders being adapted to resiliently cushion said pistons at outer and inner turning points of their reciprocating motion.

18. A machine as defined in claim 17 wherein said resilient cushions are silicon rings concentric of respective pistons and fixed in radially facing surfaces of respective said surrounding piston cylinders and wherein said pistons include corresponding radially facing surfaces to engage said silicon rings at least at the radially innermost turning point of each said piston's reciprocation.

19. A machine as defined in claim 2 wherein said lobes lie in a common plane and include indented tip portions which overlap indented tip portions of respective adjacent lobes during said orbital motion of said shafts.

20. A machine as defined in claim 2 wherein the lobes of each lobed shaft lie in one of two parallel closely spaced apart planes, the lobes of adjacent lobed shafts overlapping one another during rotation and being respectively within one and the other of said two parallel planes.

21. A machine as defined in claim 2 wherein each said lobe includes on a leading edge a raised portion located on said lobe so as to provide a point, line, or area of initial contact between said lobe and said pistons.

22. A machine as defined in claim 2 further comprising resilient cushions fixed to the pistons and surrounding piston cylinders being adapted to resiliently cushion said pistons at outer and inner turning points of their reciprocating motion.

* * * * *